US005137864A

United States Patent [19]

Yaguchi et al.

[11] Patent Number: 5,137,864

[45] Date of Patent: * Aug. 11, 1992

[54] THERMOSENSITIVE RECORDING MATERIAL

[75] Inventors: Hiroshi Yaguchi; Hisashi Sakai; Kenji Uematu; Kanjiro Kawasaki, all of Numazu, Japan

[73] Assignee: Ricoh Company, Ltd., Tokyo, Japan

[ * ] Notice: The portion of the term of this patent subsequent to Apr. 10, 2007 has been disclaimed.

[21] Appl. No.: 472,221

[22] Filed: Jan. 30, 1990

Related U.S. Application Data

[63] Continuation of Ser. No. 238,852, Sep. 1, 1988, Pat. No. 4,916,111.

[30] Foreign Application Priority Data

Sep. 1, 1987 [JP] Japan ..... 62-219348

[51] Int. Cl.[5] ..... B41M 5/30; B41M 5/40

[52] U.S. Cl. ..... 503/226; 427/152; 428/212; 428/213; 428/310.5; 428/318.4; 428/913; 503/200

[58] Field of Search ..... 503/200, 226; 428/212, 428/213, 310.5, 318.4, 913; 427/152

[56] References Cited

U.S. PATENT DOCUMENTS 4,916,111 4/1990 Yaguchi et al. ..... 503/226

*Primary Examiner*—Pamela R. Schwartz

*Attorney, Agent, or Firm*—Oblon, Spivak, McClelland, Maier & Neustadt

[57] ABSTRACT

A thermosensitive recording material comprising a support, an intermediate layer including a foamed portion with minute voids on the support, and a thermosensitive coloring layer formed on the intermediate layer is disclosed, which is particularly improved in such a manner that the voidage of the upper portion of the intermediate layer close to the thermosensitive coloring layer is smaller than the voidage of the lower portion of the intermediate layer close to the support, or the voidage of the intermediate layer is increased from the upper portion thereof towards the lower portion thereof.

6 Claims, No Drawings

THERMOSENSITIVE RECORDING MATERIAL

This is a continuation of application Ser. No. 07/238,852, filed on Sep. 1, 1988, now U.S. Pat. No. 4,916,111.

BACKGROUND OF THE INVENTION

The present invention relates to a thermosensitive recording material, and more particularly to a thermosensitive recording material with an improved thermal coloring sensitivity, which thermosensitive recording material comprises a support, an intermediate layer formed on the support, and a thermosensitive coloring layer formed on the intermediate layer.

Recently, the thermosensitive recording materials have been employed in a variety of fields, for instance, for use with recorders, terminal printers, facsimile apparatus, automatic ticket vending apparatus, and bar code readers.

In accordance with recent remarkable diversification of the application of the above-mentioned recording apparatus and the improvement of the performance, there is a great demand for thermosensitive recording sheets which can complement those improved apparatus. In particular, a thermosensitive recording sheet with an improved thermal coloring sensitivity is greatly demanded in accordance with the increased operation speed of facsimile apparatus. Thus, varieties of thermosensitive recording materials have been proposed to satisfy the above-mentioned requirements.

For example, as a method of increasing the thermal coloring sensitivity of the thermosensitive recording material, there is widely known a method of adding a thermofusible material to the conventional thermosensitive recording material in order to lower the coloring initiation temperature thereof, as disclosed in Japanese Laid-Open Patent Applications 49-34842, 52-106746 and 53-39139 However, the above-prepared thermosensitive recording material has the shortcomings that the background of such a thermosensitive recording sheet is also slightly colored at high temperatures, that dust is formed from the recording material in the course of thermosensitive recording by use of the thermal head which comes into contact with the surface of the thermosensitive recording material, and that the thermosensitive recording sheet sticks to the thermal head.

On the other hand, for the purpose of increasing the thermal coloring sensitivity of the thermosensitive recording material, there is also known a method of smoothing the surface of the thermosensitive coloring layer. By this method, the thermosensitive coloring layer of the thermosensitive recording material is brought into contact with the thermal head more closely, which causes the thermal energy provided by the thermal head to be efficiently absorbed in the thermosensitive coloring layer. This method of smoothing the surface of the thermosensitive coloring layer is usually carried out under application of pressure by use of a supercalender. Therefore, this method has the shortcomings that the background of the thermosensitive recording material is colored during the calendering process and the surface of the thermosensitive coloring layer becomes so glossy that the appearance of the recording material is impaired.

In addition, there have been proposed thermosensitive recording materials, in which an expanded layer with sufficient heat insulating properties is interposed between a support and a thermosensitive coloring layer for the purpose of effectively utilizing the thermal energy provided by a thermal head, for example, in Japanese Laid-Open Patent Applications 55-164192, 57-114658 and 59-171685. However, to improve the heat insulating properties of the above expanded layer, the voidage thereof must be increased. When the voidage of the expanded layer is increased, the surface smoothness of the expanded layer is degraded, with the result that the dots cannot be faithfully reproduced in images and recorded images are inferior in uniformity.

As an attempt to cover the above shortcoming that the surface smoothness of the expanded layer is decreased, there is proposed a method of overlaying on the expanded layer an undercoat layer comprising a filler and a binder agent, as disclosed in Japanese Laid-Open Patent Application 59-225987 This method, however, induces the complication of manufacturing processes of such a thermosensitive recording material, and accordingly the manufacturing cost is high.

Another attempt to compensate the above shortcoming is to subject the expanded layer to calendering for smoothing the surface thereof. This method has also the shortcomings that the manufacturing cost is high and that thermal conductivity of the expanded layer may be deteriorated.

Thus, a thermosensitive recording material having satisfactorily high coloring sensitivity, while maintaining high background whiteness and high heat insulating properties, has not been obtained yet.

SUMMARY OF THE INVENTION

It is therefore an object of the present invention to provide a thermosensitive recording material having high dynamic thermal coloring sensitivity, capable of uniformly yielding images, with other necessary performances for the thermosensitive recording material maintained, free from any problem of sticking between the thermal head and the recording material and fogging of the background of the thermosensitive recording material.

The above object of the present invention can be achieved by a thermosensitive recording material comprising a support, an intermediate layer including a foamed portion with minute voids, formed on the support, and a thermosensitive coloring layer formed on the intermediate layer wherein the voidage of the upper portion of the intermediate layer (a portion close to the thermosensitive coloring layer) is smaller than that of the lower portion of the intermediate layer (a portion close to the support).

DESCRIPTION OF THE PREFERRED EMBODIMENTS

The thermosensitive recording material according to the present invention comprises an intermediate layer including a foamed portion with minute voids, wherein the voidage of the upper portion of the intermediate layer is smaller than that of the lower portion of the intermediate layer, or the voidage of the intermediate layer is increased from the upper portion thereof towards the lower portion thereof, which intermediate layer is interposed between a support and a thermosensitive coloring layer. In the present invention, because of the use of the above intermediate layer having a high degree of surface smoothness and a small coefficient of thermal conductivity, the heat insulating properties of the intermediate layer are improved and the thermal energy provided by a thermal head can be effectively absorbed in the thermosensitive coloring layer, and accordingly the dynamic coloring sensitivity can be remarkably improved.

The intermediate layer of the thermosensitive recording material according to the present invention is structured in such a manner that the upper portion close to the thermosensitive coloring layer has a comparatively small voidage and high surface smoothness, and the lower portion below the above-mentioned portion in the intermediate layer has a relatively large voidage and a low thermal conductivity.

More specifically, it is preferable that the voidage of the upper portion of the intermediate layer be lower than 50%, more preferably lower than 30%. On the other hand, it is preferable that the voidage of the lower portion of the intermediate layer be 50% or more, more preferably 70% or more.

The proportion of the thickness of the upper portion of the intermediate layer to the thickness of the entire intermediate layer varies, depending on the ratio of the voidage of the upper portion to the voidage of the lower portion of the intermediate layer. Generally, it is preferable that the proportion of the thickness of the upper portion of the intermediate layer to the thickness of the entire intermediate layer be 50% or less, more preferably in the range of 10 to 35%.

When the thickness proportion of the upper portion of the intermediate layer, which portion shows a comparatively low voidage, to the entire thickness of the intermediate layer is extremely high, the average voidage of the intermediate layer is lowered, with the result that the intermediate layer does not function as a heat insulating layer.

On the contrary, when the thickness proportion of the upper portion of the intermediate layer to the entire thickness of the intermediate layer is extremely low, the surface smoothness is degraded and the desired object cannot be achieved.

The intermediate layer including a foamed portion with minute voids for use in the present invention can be formed by providing on a support an intermediate layer which includes minute void particles of an expandable plastic filler and expanding the expandable plastic filler under application of heat thereto.

The expandable plastic filler for use in the present invention is a plastic filler having minute voids therein, which comprises a thermoplastic material serving as a shell and a low boiling point solvent contained in the shell, which expandable plastic filler can be expanded under application of heat thereto.

As such expandable plastic fillers, a variety of conventionally known materials in the field of thermosensitive recording materials can be employed. It is preferable that the particle diameter of the expandable plastic filler be in the range of 2 to 50 μm, more preferably in the range of 5 to 20 μm in the unexpanded state thereof. It is preferable that the particle diameter of the expandable plastic filler be in the range of 10 to 100 μm, more preferably in the range of 10 to 50 μm in the expanded state thereof.

As the thermoplastic resin for the shell of this plastic filler, polystyrene, polyvinyl chloride, polyvinylidene chloride, polyvinyl acetate, polyacrylic acid ester, polyacrylonitrile, polybutadiene and copolymers of the above can be employed. As the blowing (expanding) agent placed in the shell, hydrocarbon such as methane, ethane, propane, isobutane can be employed.

The intermediate layer including a foamed portion with minute voids for use in the present invention can be basically prepared by the conventional method of dispersing an expandable plastic filler, and a conventional binder such as water-soluble polymers and water-based emulsions in water, coating the above dispersion on the support, and then expanding it under application of heat thereto. In the present invention, however, a more delicate and well-controlled heating and expanding method is required to provide the intermediate layer. This is because the intermediate layer, wherein the voidage of the portion close to the thermosensitive coloring layer is smaller than that of the portion close to the support, must be prepared by the above-mentioned heating and expanding method in the present invention.

More specifically, the shell of an expandable plastic filler particle for use in the present invention is softened under application of heat thereto. The above shell is expanded by the vapor pressure of the low boiling point solvent contained therein. In the course of this expanding process, the low boiling point solvent contained in the shell starts to permeate gradually through the shell. Under the application of heat to the plastic filler, the expanding process continues until the internal pressure of the plastic filler particle is balanced with the external pressure applied to the particle and the dilatation of the particle arrives at its peak. After that, the shell starts to shrink because gasses placed in the shell come out, and accordingly the dilatation of the particle is decreased. At the peak of the dilatation of the particle and therearound, the shells of the particles are fused together, so that a plurality of expandable plastic filler particles is left in the fused state after the shrinkage of the shell.

When a heating roller or heating plate is brought into contact with the intermediate layer for use in the present invention, or heated air is blown upon the surface of the intermediate layer to expand it, it is at the portion close to the surface of the intermediate layer that the dilatation of the expandable plastic filler particle first attains its peak. Then, this portion close to the surface of the intermediate layer first enters upon the shrinking phase. The reason is that the surface of the intermediate layer is first provided with a most quantity of thermal energy.

Therefore, from the above-mentioned theory, the intermediate layer for use in the present invention is generally formed by such a heating and expanding method that the application of heat to the intermediate layer is continued until the expandable plastic filler particles at the portion close to the surface in the intermediate layer and therearound are shrunk and the expandable plastic filler particles at the middle and lower portions in the intermediate layer expand to a great extent. In the thus formed intermediate layer, the portion close to the surface shows a low voidage, and on the other hand, the middle and lower portions show a high voidage.

The intermediate layer including a foamed portion with minute voids for use in the present invention can be structured by the above-mentioned heating and expanding method. This intermediate layer exhibits a high surface smoothness and a small thermal conductivity.

When the thermal energy provided for the intermediate layer is not enough, the expandable plastic filler particles are not so sufficiently shrunk at the portion close to the surface in the intermediate layer that the desired surface smoothness thereof cannot be obtained. When the thermal energy provided for the intermediate layer is excessive, the intermediate layer having the desired low thermal conductivity cannot be obtained.

The optimum heating conditions to form the intermediate layer for use in the present invention vary, depending on the type of an expandable plastic filler employed, in particular the type of a material serving as a material for the shell, and the type of a solvent placed in the shell, and further, the type of a binder agent used with the solvent, and the thickness of the coated solution containing the expandable plastic filler. Generally, the intermediate layer is heated to a temperature above the softening point of the material for the shell. Furthermore, it is preferable that the application of heat to the intermediate layer be continued until the thickness of the intermediate layer is decreased to 95 to 40%, more preferably to 85 to 60%, as compared with the thickness of the intermediate layer obtained when the dilatation of the expandable plastic filler particles attains its peak.

According to the present invention, in the intermediate layer, the expandable plastic filler particles in the vicinity of the thermosensitive coloring layer must be more effectively caused to enter upon the shrinking phase, as compared with the expandable plastic filler particles in the vicinity of the support. Otherwise the desired intermediate layer having a high surface smoothness and a small thermal conductivity would not be obtained. Alternatively, by shrinking only the expandable plastic filler particles in the vicinity of the thermosensitive coloring layer and decreasing the voidage thereof in order to obtain high surface smoothness, and by increasing the voidage of the portion below the portion in the vicinity of the thermosensitive coloring layer in order to obtain low thermal conductivity, the intermediate layer according to the present invention can be obtained.

Therefore, the intermediate layer for use in the present invention can be formed by other methods than the previously described method. For example, when the voidage of the intermediate layer is controlled to a desired voidage by utilizing the shrinkage of the expandable plastic filled particles, there is a method of providing more thermal energy for the portion in the intermediate layer, close to the thermosensitive coloring layer, than for the portion close to the support. However, according to this method, the intermediate layer is heated through the support by attaching the surface of the support to a heating drum or blowing heated air upon the surface of the support. By such a heating method, the expandable plastic filler particles in the vicinity of the thermosensitive coloring layer are restricted to expand to some extent. Therefore, it is necessary to control the heating conditions so as to obtain the desired surface smoothness.

There is another method of coating an organic solvent on the surface of the intermediate layer which has already been expanded under application of heat thereto, and plasticizing the shells of the expandable plastic filler particles close to the surface. Only these shells of the expandable plastic filler particles close to the surface of the intermediate layer are shrunk.

According to the present invention, a binder agent for use in the intermediate layer may be selected from the conventional water-soluble polymeric materials and/or water-based polymeric emulsions.

Examples of water-soluble polymers are polyvinyl alcohol, starch, starch derivatives, cellulose derivatives such as methoxycellulose, hydroxyethylcellulose, carboxymethylcellulose, methylcellulose, and ethylcellulose, and other water-soluble polymers such as sodium polyacrylate, polyvinyl pyrrolidone, acrylamide - acrylic acid ester copolymer, acrylamide - acrylic acid ester - methacrylic acid copolymer, alkali salts of styrene - maleic anhydride copolymer, alkali salts of isobutylene - maleic anhydride copolymer, polyacrylamide, sodium alginate, gelatin and casein.

Examples of water-based polymeric emulsions are emulsions of styrene - butadiene copolymer latex, styrene - butadiene - acrylic compound copolymer latex, vinyl acetate resin, vinyl acetate - acrylic acid copolymer, styrene - acrylic acid ester copolymer, acrylic acid ester resin, and polyurethane resin.

Further in the present invention, auxiliary additive components which are employed in the conventional thermosensitive recording materials, such as a filler, a thermofusible material (or unguent) and a surface active agent, can be employed together with the above-mentioned expandable plastic fillers and binder agents in the intermediate layer.

As the filler and the thermofusible material, the same fillers and thermofusible materials as those employed in the thermosensitive coloring layer, to be described later, can be used.

According to the present invention, the thermosensitive coloring layer comprises as the main components a leuco dye and a color developer which reacts with the above leuco dye to be colored when fused upon application of heat thereto.

As the leuco dyes for use in the present invention which are employed alone or in combination, any conventional leuco dyes for use in conventional thermosensitive materials can be employed. For example, triphenylmethane-type leuco compounds, fluoran-type leuco compounds, phenothiazine-type leuco compounds, auramine-type leuco compounds, spiropyran-type leuco compounds and indolinophthalide-type leuco compounds are preferably employed.

Specific examples of the leuco dyes are as follows:

3,3-bis(p-dimethylaminophenyl)phthalide,
3,3-bis(p-dimethylaminophenyl)-6-dimethylaminophthalide (or Crystal Violet Lactone),
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-cyclohexylamino-6-chlorofluoran,
3-dimethylamino-5,7-dimethylfluoran,
3-diethylamino-7-chlorofluoran,
3-diethylamino-7-methylfluoran,
3-diethylamino-7,8-benzfluoran,
3-diethylamino-6-methyl-7-chlorofluoran,
3-(N-p-tolyl-N-ethylamino)-6-methyl-7-anilinofluoran,
3-pyrrolidino-6-methyl-7-anilinofluoran,
2-[N-(3'-trifluoromethylphenyl)amino]-6-diethylaminofluoran,
2-[3,6-bis(diethylamino)-9-(o-chloroanilino)xanthylbenzoic acid lactam],
3-diethylamino-6-methyl-7-(m-trichloromethylanilino)fluoran,
3-diethylamino-7-(o-chloroanilino)fluoran,
3-dibutylamino-7-(o-chloroanilino)fluoran,
3-N-methyl-N-amylamino-6-methyl-7-anilinofluoran,
3-N-methyl-N-cyclohexylamino-6-methyl-7-anilinofluoran,
3-diethylamino-6-methyl-7-anilinofluoran,
3-(N,N-diethylamino)-5-methyl-7-(N,N-dibenzylamino)fluoran, Benzoyl leuco methylene blue,
6'-chloro-8'-methoxy-benzoindolino-spiropyran,
6'-bromo-3'-methoxy-benzoindolino-spiropyran,
3-(2'-hydroxy-4'-dimethylaminophenyl)-3-(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-diethylaminophenyl)-3-(2'-methoxy-5'-methylphenyl)phthalide,
3-(2'-methoxy-4'-dimethylaminophenyl)-3-(2'-hydroxy-4'-chloro-5'-methylphenyl)phthalide,
3-(N-ethyl-N-tetrahydrofurfuryl)amino-6-methyl-7-anilinofluoran,
3-N-ethyl-N-(2-ethoxypropyl)amino-6-methyl-7-anilinofluoran,
3-(N-methyl-N-isopropyl)amino-6-methyl-7-anilinofluoran,
3-morpholino-7-(N-propyl-trifluoromethylanilino)fluoran,
3-pyrrolidino-7-trifluoromethylanilinofluoran,
3-diethylamino-5-chloro-7-(N-benzyl-trifluoromethylanilino)fluoran,
3-pyrrolidino-7-(di-p-chlorophenyl)methylaminofluoran,
3-diethylamino-5-chloro-7-(α-phenylethylamino)fluoran,
3-(N-ethyl-p-toluidino)-7-(α-phenylethylamino)fluoran,
3-diethylamino-7-(o-methoxycarbonylphenylamino)-fluoran,
3-diethylamino-5-methyl-7-(α-phenylethylamino)fluoran,
3-diethylamino-7-piperidinofluoran,
3-chloro-3-(N-methyltoluidino)-7-(p-n-butylanilino)-fluoran,
3-dibutylamino-6-methyl-7-anilinofluoran,
3,6-bis(dimethylamino)fluorenespiro(9,3')-6'-dimethylaminophthalide,
3-(N-benzyl-N-cyclohexylamino)-5,6-benzo-7-α-naphthylamino-4'-bromofluoran,
3-diethylamino-6-chloro-7-anilinofluoran,
3-diethylamino-6-methyl-7-mesidino-4',5'-benzofluoran,
3-N-methyl-N-isopropyl-6-methyl-7-anilinofluoran,
3-N-ethyl-N-amil-6-methyl-7-anilinofluoran, and
3-diethylamino-6-methyl-7-(2',4'-dimethylanilino)fluoran.

As the color developers for use in the present invention, a variety of electron acceptors or oxidizers, capable of reacting with the above leuco dye under application of heat to induce color formation in the leuco dyes, which are conventionally known, can be employed.

Specific examples of such color developers are as follows:
4,4'-isopropylidenebisphenol,
4,4'-isopropylidenebis(o-methylphenol),
4,4'-sec-butylidenebisphenol,
4,4'-isopropylidenebis(2-tert-butylphenol),
4,4'-cyclohexylidenediphenol,
4,4'-isopropylidenebis(2-chlorophenol),
2,2'-methylenebis(4-methyl-6-tert-butylphenol),
2,2'-methylenebis(4-ethyl-6-tert-butylphenol),
4,4'-butylidenebis(6-tert-butyl-2-methyl)phenol,
1,1,3-tris(2-methyl-4-hydroxy-5-tert-butylphenyl)butane,
1,1,3-tris[2-methyl-4-hydroxy-5-cyclohexylphenyl)butane,
4,4'-thiobis(6-tert-butyl-2-methyl)phenol,
4,4'-diphenolsulfone,
4-isopropoxy-4'-hydroxydiphenylsulfone,
4-benzyloxy-4'-hydroxydiphenylsulfone,
4,4'-diphenolsulfoxide,
isopropyl p-hydroxybenzoate,
benzyl p-hydroxybenzoate,
benzyl protocatechuate,
gallic acid stearyl,
gallic acid lauryl,
gallic acid octyl,
1,7-bis(4-hydroxyphenylthio)-3,5-dioxaheptane,
1,5-bis(4-hydroxyphenylthio)-3-oxapentane,
1,3-bis(4-hydroxyphenylthio)-propane,
1,3-bis(4-hydroxyphenylthio)-2-hydroxypropane,
N,N'-diphenylthiourea,
N,N'-di(m-chlorophenyl)thiourea,
salicylanilide,
5-chloro-salicylanilide,
2-hydroxy-3-naphthoic acid,
2-hydroxy-1-naphthoic acid,
1-hydroxy-2-naphthoic acid,
zinc hydroxynaphthoic acid,
aluminum hydroxynaphthoic acid,
calcium hydroxynaphthoic acid,
bis(4-hydroxyphenyl)methyl acetate,
bis(4-hydroxyphenyl)benzyl acetate,
1,3-bis(4-hydroxy)cumylbenzene,
1,4-bis(4-hydroxy)cumylbenzene,
2,4'-diphenylsulfone,
2,2'-diallyl-4,4'-diphenolsulfone,
3,4-dihydroxyphenyl-4'-methylphenylsulfone,
α,α-bis(4-hydroxyphenyl)-α-methyltoluene,
antipyrine complex of zinc thiocyanate,
tetrabromobisphenol A, and
tetrabromobisphenol S.

In the present invention, a variety of conventional binder agents can be employed for binding the above-mentioned leuco dyes and color developers in the thermosensitive coloring layer to the intermediate layer. Specific examples of such binder agents are the same as those employed in the above-described intermediate layer.

Further in the present invention, auxiliary additive components which are employed in the conventional thermosensitive recording materials, such as a filler, a thermofusible material (or unguent) and a surface active agent can be employed together with the above-mentioned leuco dyes and color developers.

As the filler, inorganic fillers such as calcium carbonate, silica, zinc oxide, titanium oxide, aluminum hydroxide, zinc hydroxide, barium sulfate, clay, talc, surface-treated calcium, and surface-treated silica, and organic fillers such as urea - formaldehyde resin, styrene - methacrylic acid copolymer, and polystyrene resin can be employed.

As the thermofusible material, for example, higher fatty acids, esters, amides and metallic salts thereof, waxes, condensation products of aromatic carboxylic acids and amines, benzoic acid phenyl esters, higher straight chain glycols, 3,4-epoxy-dialkyl hexahydrophthalate, higher ketones and other thermofusible organic compounds having melting points ranging from about 50° C. to 200° C. can be employed.

According to the present invention, a protective layer can be overlaid on the thermosensitive coloring layer for the purpose of increasing the thermal head matching properties and improving the preservability of recorded images. When the protective layer is provided, the previously mentioned fillers, binder agents, surface active agents and thermofusible materials (unguent) can be contained in the protective layer.

The present invention will now be explained in detail by referring to the following examples.

EXAMPLE 1

Preparation of Intermediate Layer Coating Liquid (A-1)

A mixture of the following components was dispersed and stirred, whereby an intermediate layer coating liquid (A-1) was prepared:

| | Parts by Weight |
|---|---|
| Expandable plastic filler (unexpanded) (Trademark "Matsumoto Micro Sphere F30" made by Matsumoto Yushi-Seiyaku Company, Ltd.) | 15 |
| 50% styrene - butadiene copolymer latex (Trademark "Almatex E-3450" made by Mitsui Toatsu Chemicals, Inc.) | 30 |
| Water | 55 |

The above intermediate layer coating liquid (A-1) was coated on a sheet of commercially available high quality paper having a thickness of 60 μm in a deposition amount of about 3.0 g/m$^2$ on dry basis, and the coated liquid was dried to form an intermediate layer. The heated air at 120° C. was then blown upon the above-prepared coated surface of the intermediate layer. After the application of heat for 3 minutes, the dilatation of the above intermediate layer attained its peak and the thickness of the entire coated sheet became 120 μm. The voidage of the intermediate layer was about 75%. For another 1 minute, 4 minutes in total, the intermediate layer was heated by the heated air. The shrinkage of the expandable plastic filler particles was advanced in the vicinity of the surface and the voidage of the entire intermediate layer was decreased, so that a coated paper having a thickness of 105 μm in its entirety was obtained.

The surface of the thus prepared intermediate layer was first observed by an electron microscope. It was confirmed that the expandable plastic filler particles in the vicinity of the surface were collapsed due to the shrinkage, and fused together. As a result, the surface of the intermediate layer was more uniform compared with that obtained at the peak of dilatation of the expandable plastic filler particles.

Next, a cross section of the above intermediate layer was observed by an electron microscope. It was confirmed that in the upper approximately quarter part of the intermediate layer, the voidage thereof was decreased to about 25%, and on the other hand, in the lower approximately half part of the intermediate layer, the voidage thereof was not changed as compared with when the dilatation of expandable filler particles reached its peak, but maintained at about 75%.

Preparation of Thermosensitive Coloring Layer Coating Liquid (B-1)

The following respective mixtures were separately ground and dispersed, Liquid (C-1) and Liquid (D-1), both having an average particle diameter of 1.5 μm, were prepared.

| | Parts by Weight |
|---|---|
| Composition of Liquid (C-1): | |
| 3-(N-cyclohexyl-N-methyl)amino-6-methyl-7-anilinofluoran | 20 |
| 10% aqueous solution of polyvinyl alcohol | 20 |
| Water | 60 |
| Composition of Liquid (D-1): | |
| Benzyl p-hydroxybenzoate | 20 |
| Calcium carbonate | 10 |
| 10% aqueous solution of polyvinyl alcohol | 30 |
| Water | 40 |

A mixture of Liquid (C-1) and Liquid (D-1) with a mixing ratio of 1 : 3 by weight was stirred, so that a thermosensitive coloring layer coating liquid (B-1) was prepared.

This thermosensitive coloring layer coating liquid (B-1) was coated on the surface of the above-prepared coated sheet (A-1) in a deposition amount of 3.0 g/m$^2$ on dry basis, and the coated liquid was dried to form a thermosensitive coloring layer, whereby a thermosensitive recording material No. 1 according to the present invention was prepared.

COMPARATIVE EXAMPLE 1

Example 1 was repeated except that the application of heated air at 120° C. to the intermediate layer was stopped in 3 minutes when the dilatation of the expandable plastic filler particles reached its peak, whereby a comparative thermosensitive recording material No. 1 was prepared.

COMPARATIVE EXAMPLE 2

Example 1 was repeated except that the intermediate layer prepared in the same manner as employed in Comparative Example 1 was subjected to supercalendering under application of a pressure of 20 kg/cm$^2$, whereby a comparative thermosensitive recording material No. 2 was prepared.

COMPARATIVE EXAMPLE 3

Preparation of Intermediate Layer Coating Liquid (A-2)

A mixture of the following components was stirred, whereby an intermediate layer coating liquid (A-2) was prepared:

| | Parts by Weight |
|---|---|
| Finely-divided 40% polystyrene filler emulsion (Trademark "Almatex PP-1" made by Mitsui Toatsu Chemicals, Inc.) | 37.5 |
| 50% styrene - butadiene copolymer latex (Trademark "Almatex E-3450" made by Mitsui Toatsu Chemicals, Inc. | 30 |
| Water | 32.5 |

The above intermediate layer coating liquid (A-2) was coated on a sheet of commercially available high quality paper having a thickness of 60 μm in a deposition amount of about 3.0 g/m$^2$ on dry basis, and the coated liquid was dried, so that an intermediate layer was formed without application of heat thereto.

The same thermosensitive coloring layer coating liquid as employed in Example 1 was coated on the surface of the above-prepared coated sheet in a deposition amount of 3.0 g/m$^2$ on dry basis, and the coated liquid was dried to form a thermosensitive coloring layer, whereby a comparative thermosensitive recording material No. 3 was prepared.

COMPARATIVE EXAMPLE 4

The following mixture was ground and dispersed, Liquid (E-1), having an average particle diameter of 1.5 μm, was prepared.

| | Parts by Weight |
|---|---|
| Parabenzylbiphenyl | 20 |
| 10% aqueous solution of polyvinyl alcohol | 20 |
| Water | 30 |

A mixture of Liquid (C-1), Liquid (D-1) and Liquid (E-1) with a mixing ratio of 1 :3 : 3 by weight was stirred, so that a thermosensitive coloring layer coating liquid (B-2) was prepared.

This thermosensitive coloring layer coating liquid (B-2) was coated on the same sheet of commercially available high quality paper as employed in Example 1 in a deposition amount of 4.6 g/m$^2$ on dry basis, and the coated liquid was dried, whereby a comparative thermosensitive recording material No. 4 was prepared.

COMPARATIVE EXAMPLE 5

The same thermosensitive coloring layer coating liquid (B-1) as employed in Example 1 was coated on the same sheet of commercially available high quality paper as employed in Example 1 in a deposition amount of 4.6 g/m$^2$ on dry basis, and the coated liquid was dried, whereby a comparative thermosensitive recording material No. 5 was prepared.

The thermosensitive recording material No. 1 according to the present invention and the comparative thermosensitive recording materials No. 1 through No. 5 were subjected to (i) dynamic thermal coloring sensitivity tests to evaluate the thermal coloring sensitivity thereof, and (ii) dot reproduction tests to evaluate the recorded image uniformity thereof, respectively. Further, the above thermosensitive recording materials were allowed to stand at 60° C. for 24 hours for measuring the background density thereof, from which the heat resistant stability of each recording material was assessed and evaluated. At the same time, it was checked whether dust formed from the thermosensitive recording materials adhered to a thermal head, and whether the sticking problem of the recording materials to the thermal head occurred in the course of the above-mentioned thermal recording tests. The results are shown in Table 1.

The above-described tests were conducted by performing thermal printing on each of the above thermosensitive recording materials by a thermal printing test apparatus having an 8 dots/mm thermal head (commercially available by Matsushita Electronic Components Co., Ltd.), under the conditions that the electric power applied to the thermal head was 0.7 W/dot, the main scanning recording speed was 10 msec/line, the sub-scanning density was 7.7 line/mm, with the pulse width changed to 0.3 msec, 0.35 msec and 0.4 msec. The image densities of the formed images were measured by use of a Macbeth densitometer RD-514 with a filter Wratten-106 attached thereto.

TABLE 1

| Example No. | Thermosensitive Recording Material | Dynamic Thermal Coloring Density | | | Heat-Resistant Preservability | | Dust from Recording Material | Image Uniformity |
|---|---|---|---|---|---|---|---|---|
| | | 0.3 msec | 0.35 msec | 0.4 msec | Before Test | After Test | Sticking | (*) |
| Example 1 | No. 1 | 0.73 | 1.11 | 1.35 | 0.07 | 0.09 | Good | ○ |
| Comparative Example 1 | No. 1 | 0.68 | 1.05 | 1.34 | 0.07 | 0.09 | Good | X |
| Comparative Example 2 | No. 2 | 0.70 | 1.09 | 1.35 | 0.07 | 0.09 | Good | Δ |
| Comparative Example 3 | No. 3 | 0.50 | 0.80 | 1.08 | 0.07 | 0.09 | Good | Δ |
| Comparative Example 4 | No. 4 | 0.49 | 0.78 | 1.11 | 0.08 | 0.24 | Not good | X |
| Comparative Example 5 | No. 5 | 0.33 | 0.57 | 0.81 | 0.07 | 0.09 | Good | X |

Note(*): Image Uniformity
○ . . . Good; Δ . . . Slightly poor; X . . . Very poor It is obvious, as shown in Table 1, that the thermosensitive recording material according to the present invention, capable of yielding uniform images without any sticking problem, shows high dynamic thermal coloring sensitivity and superior heat resistant stability.

What is claimed is:

1. In a thermosensitive recording material comprising: a support, an intermediate layer including a foamed portion with minute voids on said support, and a thermosensitive coloring layer formed on said intermediate layer, the improvement wherein the voidage of the upper portion of said intermediate layer close to said thermosensitive coloring layer is smaller than the voidage of the lower portion of said intermediate layer close to said support.

2. The thermosensitive recording material as claimed in claim 1, wherein the voidage of said intermediate layer increases from said upper portion thereof towards said lower portion thereof.

3. The thermosensitive recording material as claimed in claim 1, wherein the voidage of the upper portion of said intermediate layer close to said thermosensitive coloring layer is less than 50%, and the voidage of the lower portion of said intermediate layer close to said support is more than 50%.

4. The thermosensitive recording material as claimed in claim 1, wherein the voidage of the upper portion of said intermediate layer close to said thermosensitive coloring layer is less than 30%, and the voidage of the lower portion of said intermediate layer close to said support is more than 70%.

5. The thermosensitive recording material as claimed in claim 1, wherein the ratio of the thickness of the upper portion of said intermediate layer to the entire thickness of said intermediate layer is 50% or less.

6. The thermosensitive recording material as claimed in claim 1, wherein the ratio of the thickness of the upper portion of said intermediate layer to the entire thickness of said intermediate layer is in the range of about 35% to 10%.

* * * * *

UNITED STATES PATENT AND TRADEMARK OFFICE

CERTIFICATE OF CORRECTION

PATENT NO. : 5,137,864

DATED : August 11, 1992

INVENTOR(S) : HIROSHI YAGUCHI ET AL

It is certified that error appears in the above-identified patent and that said Letters Patent is hereby corrected as shown below:

Col. 1, line 39, insert a period --.-- after 53-39139.

Col. 2, line 17, insert a period --.-- after 59-225987.

Col. 5, line 41, delete "filled" insert --filler--.

Col. 6, line 30, insert a comma --,-- after "invention".

Col. 7, line 18, insert a hyphen -- - --, after "..anilino)", and before "fluoran".

Col. 7, line 33, delete "3-chloro-3-", insert --2-chloro-3- --.

Col. 7, line 65, delete "[2-methyl-", insert --(2-methyl- --.

Signed and Sealed this

Twenty-sixth Day of October, 1993

*Attest:*

*Attesting Officer*

Bruce Lehman

BRUCE LEHMAN

*Commissioner of Patents and Trademarks*